US006273307B1

(12) United States Patent
Gross et al.

(10) Patent No.: US 6,273,307 B1
(45) Date of Patent: Aug. 14, 2001

(54) FITMENT FOR A POUCH OPENING

(75) Inventors: Richard A. Gross, Oconomowoc; Daniel G. Schantz, Muskego, both of WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 09/640,614

(22) Filed: Aug. 17, 2000

(51) Int. Cl.[7] ..... B65D 35/38; B65D 33/16

(52) U.S. Cl. ..... 222/566; 222/92; 383/96; 383/906; 220/613

(58) Field of Search ..... 222/92, 107, 566, 222/490, 494; 383/80, 96, 906; 220/601, 612, 613; 215/232, 44, 370

(56) References Cited

U.S. PATENT DOCUMENTS

| | | | |
|---|---|---|---|
| 2,129,839 | 9/1938 | Henderson . | |
| 3,157,312 | 11/1964 | Kitterman . | |
| 3,690,524 * | 9/1972 | Haberhauer | 222/566 |
| 3,963,026 | 6/1976 | Herb . | |
| 4,011,968 | 3/1977 | McGhie . | |
| 4,090,541 | 5/1978 | Cammarat, III et al. . | |
| 4,162,030 | 7/1979 | Capra et al. . | |
| 4,193,513 | 3/1980 | Bull, Jr. . | |
| 4,205,765 | 6/1980 | May . | |
| 4,244,409 | 1/1981 | Wilson et al. . | |
| 4,378,069 | 3/1983 | Franco . | |
| 4,452,378 | 6/1984 | Christine . | |
| 4,484,351 | 11/1984 | Leeuwe et al. . | |
| 4,570,827 | 2/1986 | Roggenberg, Jr. et al. . | |
| 4,595,126 | 6/1986 | Holmes . | |
| 4,598,839 | 7/1986 | Dombroski et al. . | |
| 4,732,299 | 3/1988 | Hoyt . | |

(List continued on next page.)

FOREIGN PATENT DOCUMENTS

| | | | |
|---|---|---|---|
| 677093-A5 * | 4/1991 | (CH) | 383/80 |
| 29706158 | 8/1997 | (DE) . | |
| WO 00/06464 A | 2/2000 | (WO) . | |

OTHER PUBLICATIONS

U.S. Patent application Ser. No. 08/843,165.
U.S. Patent application Ser. No. 08/915,960.

*Primary Examiner*—Kevin Shaver
*Assistant Examiner*—Patrick Buechner
(74) *Attorney, Agent, or Firm*—Rockey, Milnamow & Katz, Ltd.

(57) ABSTRACT

A fitment for being sealed to a collapsible pouch has a body having at least one side wall portion, which is provided with spaced steps defining spaced shoulders, an inner end, which faces the interior of the collapsible pouch when the fitment is sealed to the collapsible pouch, and an outer end. The body of the fitment defines a reference plane and a range of peripheral dimensions, each of which is measured around one of the spaced steps or around one of the spaced shoulders, in a plane that is located at one of the inner and outer ends or between the inner and outer ends and that coincides with or is parallel to the reference plane. The peripheral dimensions increase from a smallest dimension at or toward one such end, through intermediate dimensions which between the inner and outer ends do not decrease after increasing, to a largest dimension at or toward the other end. Preferably, as viewed from either of the inner and outer ends, the body of the fitment has a substantially boat-shaped periphery defining two opposite edges and two opposite, side wall portions, each having such steps defining such shoulders. A fin projects from each of the opposite edges. Each shoulder has a sealing surface for sealing to one of two web portions of the collapsible pouch when the fitment is received by an opening of the collapsible pouch. The sealing surfaces taper outwardly or inwardly from one such end of the fitment toward the other end of the fitment.

10 Claims, 5 Drawing Sheets

U.S. PATENT DOCUMENTS

| | | | |
|---|---|---|---|
| 5,036,990 | 8/1991 | Pherigo . | |
| 5,115,950 | 5/1992 | Rohr . | |
| 5,275,311 | 1/1994 | Piarrat . | |
| 5,439,143 | 8/1995 | Brown et al. . | |
| 5,511,697 | 4/1996 | Gruenbacher et al. . | |
| 5,540,358 | 7/1996 | Wiles . | |
| 5,579,945 | 12/1996 | Ichikawa et al. . | |
| 5,699,936 | 12/1997 | Sakamoto . | |
| 5,819,986 | 10/1998 | Last et al. . | |
| 5,823,383 | 10/1998 | Hins . | |
| 5,823,387 | 10/1998 | Manadanas et al. . | |
| 5,915,596 | 6/1999 | Credle, Jr. . | |
| 5,919,360 | 7/1999 | Contaxis et al. . | |
| 5,971,613 * | 10/1999 | Bell | 383/906 |
| 6,000,848 * | 12/1999 | Massioui | 383/906 |
| 6,050,451 | 4/2000 | Hess et al. . | |

* cited by examiner

FITMENT FOR A POUCH OPENING

CROSS-REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention pertains to a fitment for being sealed to a collapsible pouch. The fitment has a novel shape, which enables the fitment to be molded from a polymeric material that can be sealed to the collapsible pouch, in a simple, two-part mold that can be opened by simple, uniaxial, straight-pull movements of the mold parts relative to one another, along a line of action perpendicular to a parting interface between the mold parts, and without any side-action mold action.

BACKGROUND OF THE INVENTION

AND

TECHNICAL PROBLEMS POSED BY THE PRIOR ART

Commonly, a collapsible pouch for containing any of a wide variety of food, beverage, personal care, household care, or other similar or dissimilar products, either in liquid form or in paste form, is made from a flexible, heat-sealable, polymeric sheet or from a flexible, paperboard or metal foil sheet having a heat-sealable, polymeric lining, and has two opposed, flexible web portions sealed to one another so as to define an interior region, which is adapted to contain such a product, and so as to define an opening, which opens to the interior region. The opening is adapted to receive a fitment, which may incorporate a dispensing valve, a removable cover, or other similar or dissimilar features and which is molded from a polymeric material that can be heat-sealed to the web portions of the collapsible pouch.

An example of such a fitment, which incorporates a dispensing valve and a removable cover, is disclosed in U.S. Pat. No. 6,050,451, which is assigned to AptarGroup, Inc. of Crystal Lake, Ill. As disclosed therein, a base of the fitment has two side walls, which converge at two opposed ends of the fitment and which are oriented vertically when the fitment is oriented vertically. Moreover, each side wall has a series of spaced ribs, which project from such side wall and to which an associated one of the web portions of such a collapsible pouch can be heat-sealed.

Another example of such a fitment having a series of spaced ribs, which project from side walls that are oriented vertically when the fitment is oriented vertically and to which the web portions of such a collapsible pouch can be heat-sealed, is disclosed in U.S. Pat. No. 5,823,383, which is assigned to Georg Menshen GmbH & Co. KG of Finnentrop, Germany.

Because of the spaced ribs, which project from the side walls, molding of such a fitment, as disclosed in U.S. Pat. No. 6,050,451 or as disclosed in U.S. Pat. No. 5,823,383, requires a complex, multi-part mold, which requires complex, multi-axial movements to open the mold.

For being sealed to a collapsible pouch, as described hereinbefore, it would be advantageous to provide a fitment having a configuration, heretofore unknown, which would enable the fitment to be molded in a simple, two-part mold that can be opened by simple, uniaxial movements of the mold parts relative to one another, along a line of action perpendicular to a parting interface between the mold parts, and without any side action mold action.

SUMMARY OF THE INVENTION

This invention provides a fitment, which has a novel configuration, for being sealed to a collapsible pouch having two opposed web portions sealed to one another so as to define an interior region and so as to define an opening, which opens to the interior and which is adapted to receive the fitment when the fitment is sealed to the collapsible pouch.

The fitment has a body having at least one side wall portion, which is provided with spaced steps defining spaced shoulders. The body of the fitment has an inner end, which faces the interior of the collapsible pouch when the fitment is sealed to the collapsible pouch, and an outer end. The body of the fitment defines a reference plane, which is defined preferably by an outer periphery of a selected one of the inner and outer ends of the body of the fitment.

The body of the fitment defines a range of peripheral dimensions, each of which is measured around one of the spaced steps or around one of the spaced shoulders, in a plane that is located at one of the inner and outer ends or between the inner and outer ends and that coincides with or is parallel to the reference plane. The peripheral dimensions increase from a smallest dimension at or toward one such end, through intermediate dimensions which between the inner and outer ends do not decrease after increasing, to a largest dimension at or toward the other end.

Being characterized by the range of peripheral dimensions, as discussed, the novel configuration of the body of the fitment enables the body of the fitment to be molded in a simple, two-part mold that can be opened by simple, uniaxial, straight-pull movements of the mold parts relative to one another, along a line of action perpendicular to the parting interface, without any side-action mold action.

Preferably, as viewed from either of the inner and outer ends, the body of the fitment has a boat-shaped periphery defining two opposite edges and two opposite side wall portions, each having such steps defining such shoulders. Preferably, moreover, the body of the fitment has a fin projecting from each of the opposite edges. The projecting fins, if included, are excluded from the peripheral measurements discussed above.

Preferably, each shoulder has a sealing surface for sealing to one of the web portions of the collapsible pouch when the fitment is received by the opening of the collapsible pouch, the sealing surfaces tapering from one of the inner and outer ends of the fitment toward the other end of the fitment. If the sealing surfaces taper inwardly from the inner end toward the outer end, the peripheral dimension is largest at or toward the inner end and smallest at or toward the outer end. If the sealing surfaces taper inwardly from the outer end toward the inner end, the peripheral dimension is largest at or toward the outer end and smallest at or toward the inner end.

Numerous other objects, features, and advantages of this invention will become readily apparent from the following detailed description, from the claims, and from the accompanying drawings.

BRIEF DESCRIPTION OF THE DRAWINGS

In the accompanying drawings, in which like numerals are employed to designate like parts throughout.

DETAILED DESCRIPTION OF THE ILLUSTRATED EMBODIMENTS

While this invention is susceptible of being embodied in many different forms, this specification and the accompanying drawings disclose only some specific embodiments, as examples of fitments embodying this invention. However, this invention is not intended to be limited to the embodiments so disclosed. The scope of this invention is pointed out in the appended claims.

To facilitate their description, the disclosed embodiments are illustrated and described in selected orientations. It will be understood, however, that a fitment embodying this invention may be manufactured, stored, transported, used, and sold in orientations other than the orientations disclosed.

Figure 1:
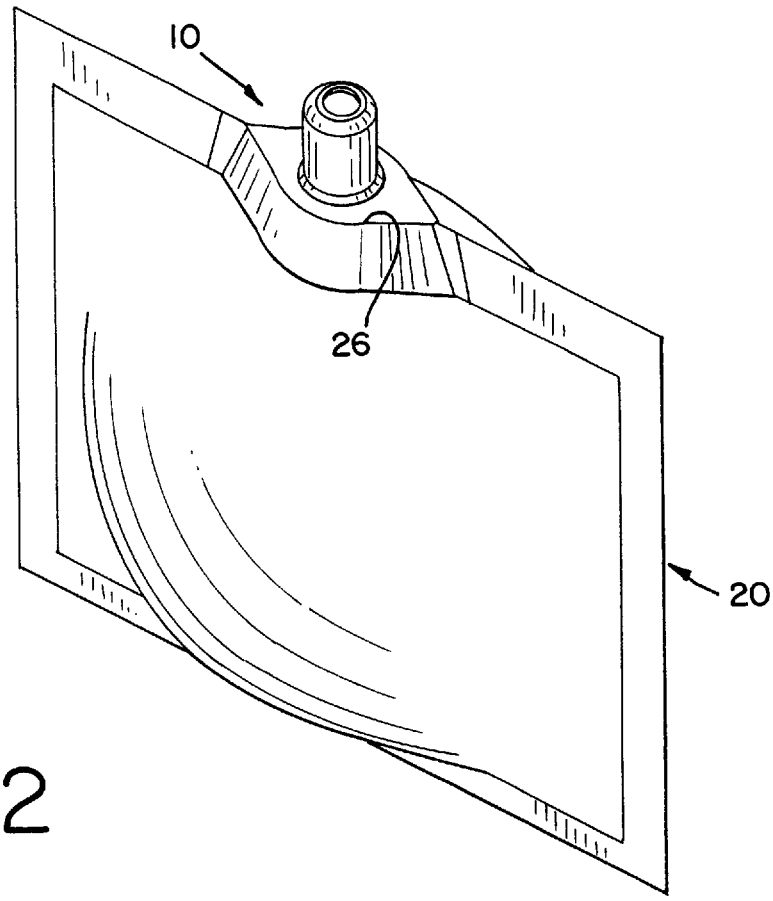
FIG. 1 is a simplified, perspective view of a collapsible pouch equipped with a fitment constituting a first embodiment of this invention, from an upper, front, right-side vantage.
Figure 2:
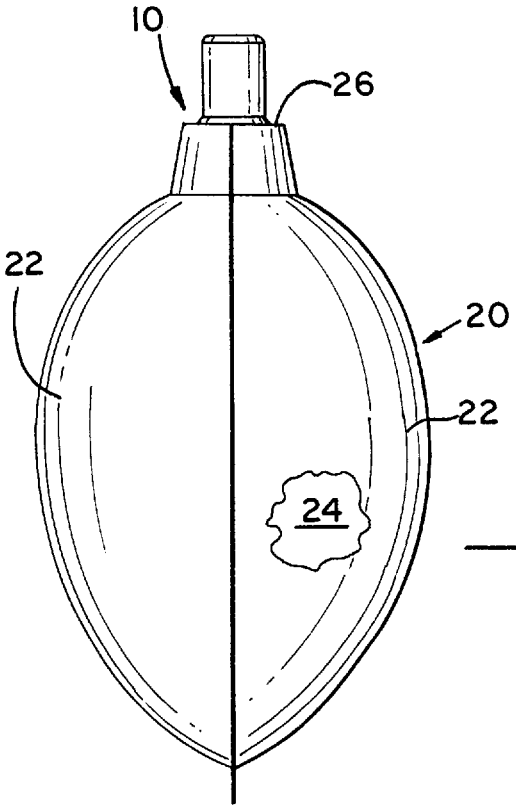
FIG. 2 is a simplified, side elevational view of the pouch and fitment, as illustrated in FIG. 1, the pouch being partially torn open so as to expose an interior region.
Figure 3:
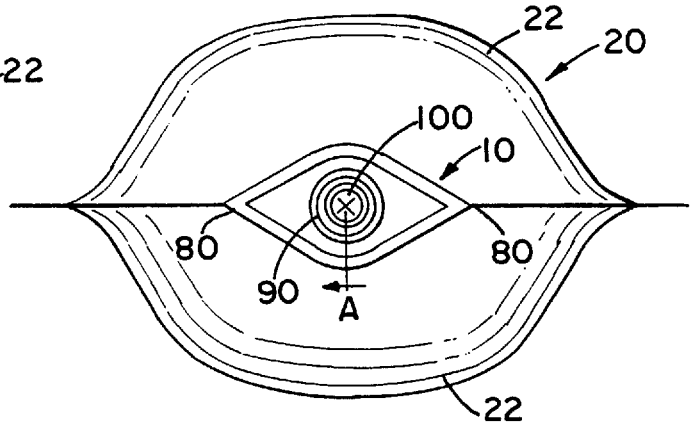
FIG. 3 is a simplified, top plan view of the pouch and fitment, as illustrated in FIGS. 1 and 2.

As illustrated in FIGS. 1, 2, and 3, a fitment 10 for being sealed to a collapsible pouch 20 for containing any of a wide variety of food, beverage, personal care, household care, or other similar or dissimilar products, either in liquid, gel, dry powder, granular, or paste form, constitutes a first embodiment of this invention.

The collapsible pouch 20, which is conventional, is made preferably from a flexible, heat-sealable, polymeric sheet or from a flexible, paperboard or metal foil sheet having a heat-sealable, polymeric lining so as to have two opposed, flexible web portions 22, as shown in FIGS. 2 and 3. The web portions 22 are sealed to one another so as to define an interior region 24, as shown in FIG. 2, and so as to define an opening 26, which opens to the interior region 24 and which is adapted to receive the fitment 10 when the fitment 10 is sealed to the collapsible pouch 20.

Figure 4:
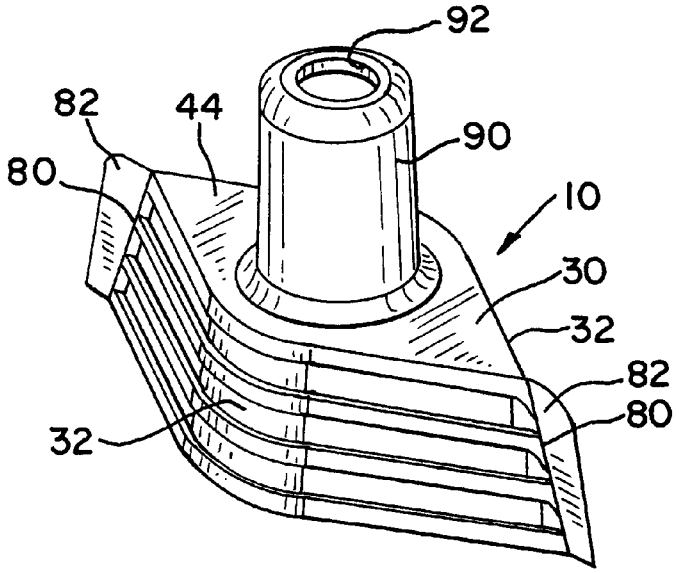
FIG. 4 is a detailed, perspective view of the fitment illustrated in FIGS. 1, 2, and 3, from an upper, front, right-side vantage.
Figure 5:
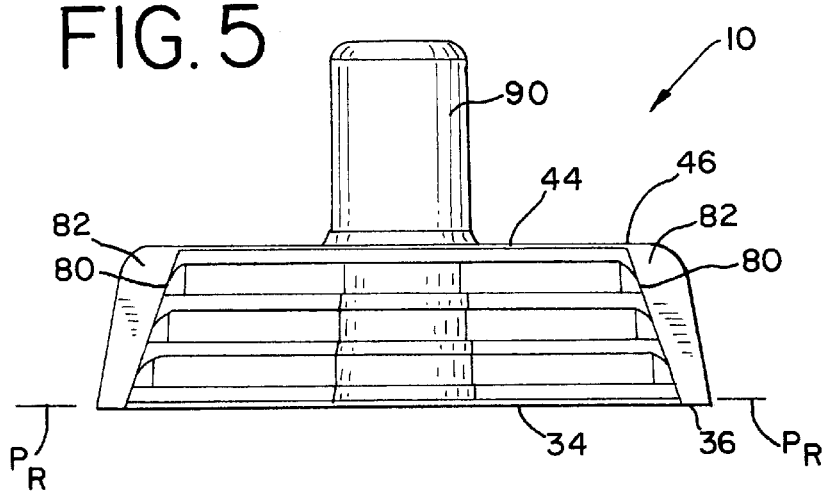
FIG. 5 is a front elevational view of the fitment illustrated in FIGS. 3 and 4.
Figure 8:
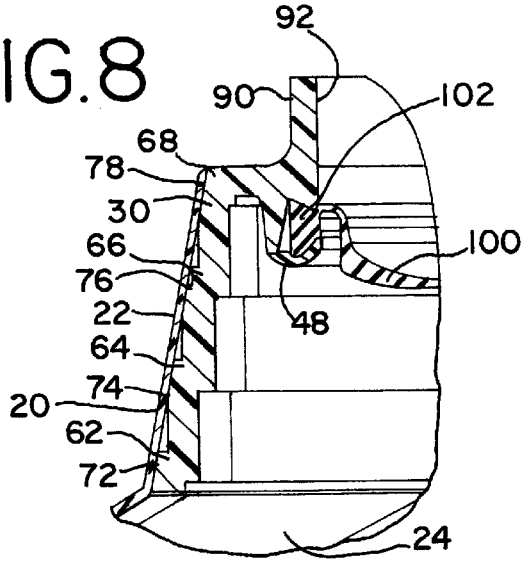
FIG. 8, on a larger scale compared to FIGS. 3 through 7, is a detailed, fragmentary, sectional view taken along line A of FIG. 3, in a direction indicated by an arrow, so as to illustrate sealing between the pouch and the fitment and so as to illustrate an internal, slit-type dispensing valve comprised by the fitment.
Figure 9:
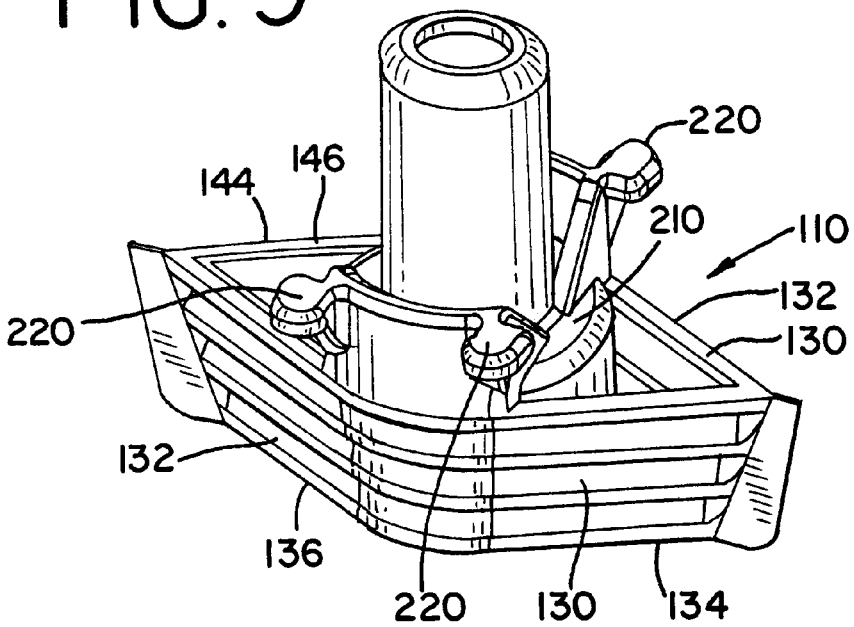
FIG. 9 is a detailed, perspective view of a fitment constituting a second embodiment of this invention, from an upper, front, right-side vantage.
Figure 10:
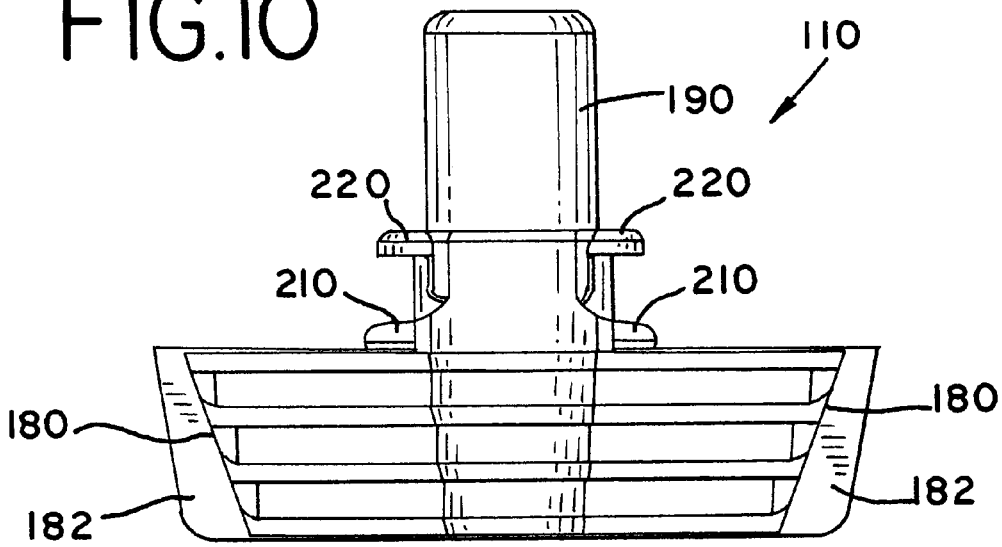
FIG. 10 is a front elevational view of the fitment illustrated in FIG. 9.

As shown in FIGS. 4, 5, 6, and 7, the fitment 10 is molded from a polymeric material, high density polyethylene (HDPE) being preferred, which is suitable to be sealed to the web portions 22 of the collapsible pouch 20 by ultrasonic bonding, which is preferred, adhesively, or otherwise. The fitment 10 is molded so as to have a cup-like body 30 opening downwardly and having two opposite, side wall portions 32, as indicated in FIG. 4, and an inner end 34 and an outer end 44, as indicated in FIG. 5. The inner end 34, which has an outer periphery 36, faces the interior region 24 of the collapsible pouch 20 when the fitment 10 is sealed to the collapsible pouch 20. The outer end 44 has an outer periphery 46. The outer periphery 36 of the inner end 34 of the fitment 10 defines a reference plane $P_R$. The fitment 10 is molded so as to have an internal, unitary sleeve 48, as shown in FIG. 8. The sleeve 48 projects downwardly within the body 30, when the fitment 10 is molded initially, but is deformed subsequently (by a process discussed hereinafter) into the curved shape shown in FIG. 8.

Figure 6:
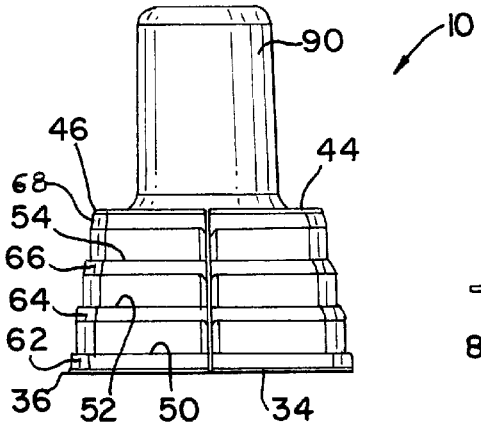
FIG. 6 is a side elevational view of the fitment illustrated in FIGS. 3, 4, and 5.
Figure 7:
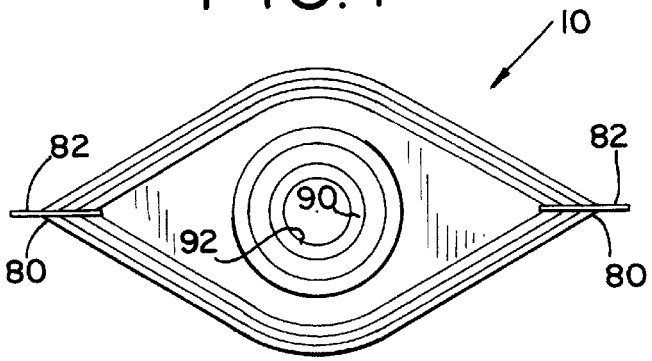
FIG. 7 is a detailed, top plan view of the fitment illustrated in FIGS. 3, 4, 5, and 6.

As shown in FIG. 6, each wall portion 32 is provided with three spaced steps 50, 52, 54, which define four spaced shoulders 62, 64, 66, 68. The shoulder 62 is near the outer periphery 36 of the inner end 34. The shoulder 68 is at the outer periphery 46 of the outer end 44. As shown in FIG. 8, the shoulder 62 has a sealing surface 72, the shoulder 64 has a sealing surface 74, the shoulder 66 has a sealing surface 76, and the shoulder 68 has a sealing surface 78. The sealing surfaces 72, 74, 76, 78 taper inwardly from the inner end 34 toward the outer end 44.

When the pouch 20 is sealed to the fitment 10 by ultrasonic bonding, which is preferred, adhesively, or otherwise, spaced regions on the interior walls of the web portions 22 are sealed to the sealing surfaces 72, 74, 76, 78 on the spaced shoulders 62, 64, 66, 68 of the fitment 10. It is known that sealing along spaced regions can be particularly effective; see, e.g., U.S. Pat. No. 6,050,451 at column 7, lines 25 through 28.

Figure 4A:
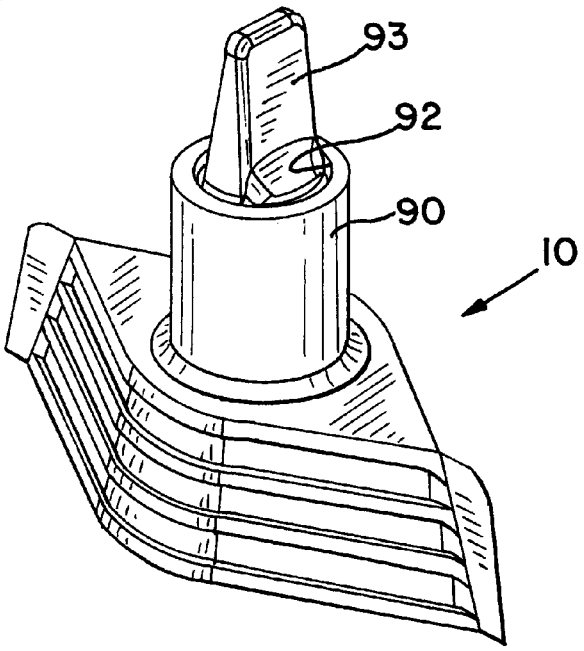
FIG. 4A is a similar, perspective view of a similar fitment equipped with an optional, break-away tab.

As viewed from either of the inner and outer ends 34, 44, the body 30 of the fitment 10 has a boat-shaped periphery defining two opposite edges 80 and defining the opposite, side wall portions 32. See FIGS. 3 and 7. Moreover, as molded, the fitment has a fin 82 projecting from each of the opposite edges 80. When the pouch 20 is sealed to the fitment 10, the web portions 22 and the fins 82 tend to fuse together. Furthermore, the fitment 10 has a unitary, tubular spout 90 projecting upwardly from the outer end 44 of the body 30 and defining a passage 92 (FIG. 7) which extends through the spout 90 and which opens into the pouch 20 when the pouch 20 is sealed to the fitment 10. Optionally, as shown in FIG. 4A, the spout 90 is provided with a unitary, break-away tab 93, which closes the passage 92 unless and until broken away from the spout 90.

The body 30 of the fitment 10 defines a range of peripheral dimensions, each of which is measured around one of the spaced steps 50, 52, 54, or around one of the spaced shoulders 62, 64, 66, 68, in a plane that is located at one of the inner and outer ends 34, 44, or between the inner and outer ends 34, 44, and that coincides with or is parallel to the reference plane $P_R$. The projecting fins 82 are excluded from the peripheral dimensions, i.e., the peripheral measurements are made as if the projecting fins 82 were omitted.

The peripheral dimensions increase from a smallest dimension at the outer end 44, through intermediate dimensions which between the inner and outer ends 34, 44, do not decrease after increasing, to a largest dimension at the inner end 34. Advantageously, therefore, the body 30 of the fitment 10 can be molded in a simple, two-part mold that defines a parting interface and that can be opened by simple, uniaxial, straight-pull movements of the mold parts relative to one another, along a line of action perpendicular to the parting interface, and without any side-action mold action.

Preferably, as shown in FIG. 8, the fitment 10 is provided with an internal, slit-type valve 100, which is mounted within the fitment 10. The valve 100 is similar structurally and functionally to valves disclosed in U.S. Pat. Nos. 5,439,143 and 6,050,451, the disclosures of which are incorporated herein to the extent pertinent hereto and to the extent not inconsistent herewith. The valve 100 is made from an elastomeric material, such as a silicone rubber. The valve 100 has an outer flange 102. As noted above, the fitment 10 has an internal, unitary sleeve 48, which projects downwardly (in a tubular shape) when the fitment 10 is molded initially. Subsequently, the valve 100 is mounted within the fitment 10. After being heated ultrasonically or otherwise, the sleeve 48 is turned under the valve flange 102 and upwardly, so as to clamp the valve flange 102 within the fitment 10 once the deformed sleeve 48 has cooled sufficiently to be dimensionally stable.

Figure 13:
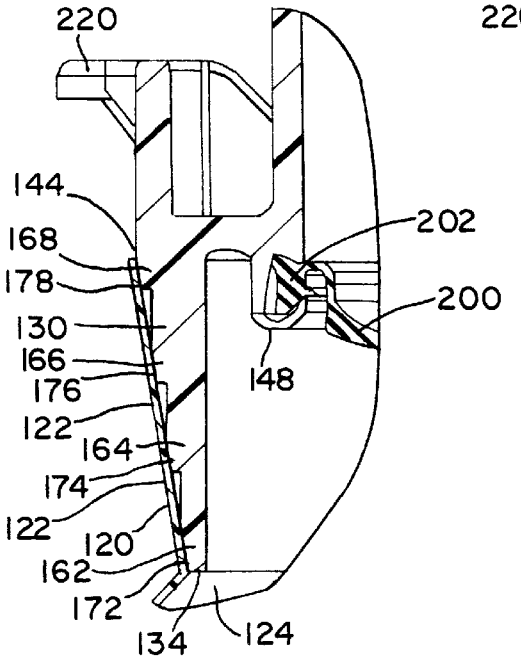
FIG. 13, on a larger scale compared to FIGS. 9, 10, 11, and 12, is a detailed, fragmentary, sectional view analogous to FIG. 8 but taken through portions of a collapsible pouch and of the fitment illustrated in FIGS. 9, 10, 11, and 12, so as to illustrate sealing between a pouch and the fitment and to as to illustrate an internal, slit-type valve comprised by the fitment.

As shown in FIGS. 9, 10, 11, 12, and 13, a fitment 110 for being sealed to a collapsible pouch 120, which is shown in FIG. 13 only and which is similar to the pouch 20, which has two web portions 122 (one shown in FIG. 13) similar to the web portions 22 and which has an interior region 124, constitutes a second embodiment of this invention. Except as illustrated or described, the fitment 110 is similar to the fitment 10. Thus, the fitment 110 is molded from a similar material and is used similarly.

Figure 11:
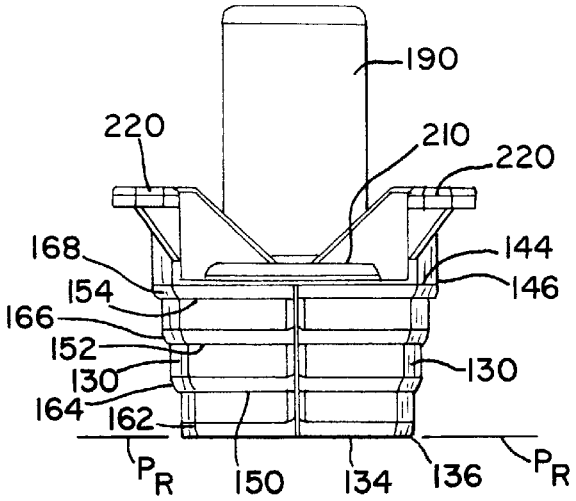
FIG. 11 is a side elevational view of the fitment illustrated in FIGS. 9 and 10.
Figure 12:
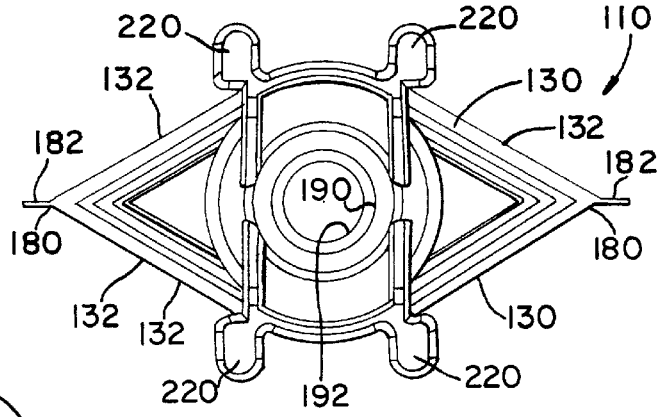
FIG. 12 is a top plan view of the fitment illustrated in FIGS. 9, 10, and 11.

The fitment 110 is molded so as to have a cup-like body 130 opening upwardly and having two opposite, side wall portions 132, an inner end 134 (FIG. 9) which has an outer periphery 136 and which faces the interior region 124 of the collapsible pouch 120 when the fitment 110 is sealed to the collapsible pouch 120, and an outer end 144 ( FIG. 9) which has an outer periphery 146. The outer periphery 136 of the inner end 134 of the fitment 110 defines a reference plane $P_R$, which is indicated in FIG. 11. The fitment 110 is molded so as to have an internal, unitary sleeve 148, which projects downwardly within the body 130 when the fitment 110 is molded initially, but is deformed subsequently (by a process discussed hereinafter) into the curved shape shown in FIG. 13.

Each wall portion 132 is provided with three spaced steps 150, 152, 154, which define four spaced shoulders 162, 164, 166, 168. The shoulder 162 is near the outer periphery 136 of the inner end 134. The shoulder 168 is at the outer periphery 146 of the outer end 144. As shown in FIG. 11, the shoulder 162 has a sealing surface 172, the shoulder 164 has a sealing surface 174, the shoulder 166 has a sealing surface 176, and the shoulder 168 has a sealing surface 178. The sealing surfaces 172, 174, 176, 178 taper inwardly from the outer end 144 toward the inner end 134.

When the pouch 120 is sealed to the fitment 110 by ultrasonic bonding, which is preferred, adhesively, or otherwise, spaced regions on the interior walls of the web portions 122 are sealed to the sealing surfaces 172, 174, 176, 178 on the spaced shoulders 162, 164, 166, 168 of the fitment 110.

As viewed from either of the inner and outer ends 134, 144, the body 130 of the fitment 110 has a boat-shaped periphery defining two opposite edges 180 and defining the opposite, side wall portions 130. See FIG. 12. Moreover, as molded, the fitment has a fin 182 projecting from each of the opposite edges 180. When the pouch 120 is sealed to the fitment 110, the web portions 122 and the fins 182 tend to fuse together. Furthermore, at its outer end 144, the fitment 110 has a unitary, tubular spout 190 projecting upwardly from the inner end 134 of the body 130 and defining a passage 192 (FIG. 12) which extends through the spout 190 and which opens into the pouch 120 when the pouch 120 is sealed to the fitment 110.

The body 130 of the fitment 110 defines a range of peripheral dimensions, each of which is measured around one of the spaced steps 150, 152, 154, or around one of the spaced shoulders 162, 164, 166, 168, in a plane that is located at one of the inner and outer ends 134, 144, at or between the inner and outer ends 134, 144, and that coincides with or is parallel to the reference plane $P_R$. The projecting fins 182 are excluded from the peripheral dimensions, i e., the peripheral measurements are made as if the projecting fins 182 were omitted.

The peripheral dimensions increase from a smallest dimension at the inner end 134, through intermediate dimensions which between the inner and outer ends 134, 144, do not decrease after increasing, to a largest dimension at the outer end 144. Advantageously, therefore, the body 130 of the fitment 110 can be molded in a simple, two-part mold that defines a parting interface and that can be opened by simple, uniaxial, straight-pull movements of the mold parts relative to one another, along a line of action perpendicular to the parting interface, without any side-action mold action.

Preferably, as shown in FIG. 13, the fitment 110 is provided with an internal, slit-type valve 200, which is sealed to and within the fitment 110. The valve 100 is similar structurally and functionally to the valve 100 and to valves disclosed in U.S. Pat. Nos. 5,439,143 and 6,050,451, supra. The valve 200 has an outer flange 202. As noted above, the fitment 110 has an internal, unitary sleeve 148, which projects downwardly (in a tubular shape) when the fitment 110 is molded initially. Subsequently, the valve 200 is mounted within the fitment 110. After being heated ultrasonically or otherwise, the sleeve 148 is turned under the valve flange 202 and upwardly, so as to clamp the valve flange 202 within the fitment 110 once the deformed sleeve 148 has cooled sufficiently to be dimensionally stable.

Optionally, the fitment 110 is molded so as to have two unitary, lower pads 210 and four unitary, upper pads 220, at its outer end 144. Such pads 210, 220, if included, are intended to coact with spaced rails (not shown) of automated handling machinery (not shown) when the fitment 110 is being handled by such machinery. Such pads 210, 220, if included, are configured so that the fitment 110 including the body 130, the sleeve 148, and such pads 210, 220, is moldable in a simple, two-part mold that can be opened by simple, uniaxial, straight-pull movements of the mold parts relative to one another, as discussed above. It should be here understood that the fitment 110 would function for its intended purposes, even if such pads 210, 220, were omitted.

It will be readily observed from the foregoing detailed description and from the accompanying illustrations that numerous other variations and modifications may be effected without departing from the true spirit and scope of the novel concepts or principles of this invention.

What is claimed is:

1. A fitment for being sealed to a collapsible pouch having two opposed, flexible web portions sealed to one another so as to define an interior region and so as to define an opening, which opens to the interior region and which is adapted to receive the fitment when the fitment is sealed to the collapsible pouch, the fitment having a body having at least one side wall portion, which is provided with spaced steps defining spaced shoulders, the body having an inner end, which faces the interior of the collapsible pouch when the fitment is sealed to the collapsible pouch, the body having an outer end and defining a reference plane, the body defining a range of peripheral dimensions, each of which is measured around one of the spaced steps or around one of the spaced shoulders, in a plane that is located at one of the inner and outer ends or between the inner and outer ends and that coincides with or is parallel to the reference plane, the peripheral dimensions increasing from a smallest dimension at or toward one said end, through intermediate dimensions that between the inner and outer ends do not decrease after increasing, to a largest dimension at or toward the other end; and each of said spaced shoulders including a tapered sealing surface that is oblique to, and defined between, an adjacent surface of said sidewall portion and an adjacent one of said steps, the following relationships being defined with reference to measurements on cross-sectional planes through said body perpendicular to said reference plane:

(1) said tapered sealing surface having a maximum lateral dimension at said adjacent surface and a minimum lateral dimension at said adjacent step, (2) said adjacent surface having a minimum lateral dimension at least as great as the maximum lateral dimension of said tapered sealing surface, (3) said minimum lateral dimension of said tapered sealing surface being at least as great as the maximum lateral dimension of said step, (4) said body sidewall portion being free of undercuts that would prohibit straight-pull mold action after said fitment is molded in a mold assembly, and (5) said tapered sealing surfaces are spaced apart for limiting the sealing of said web to said body sidewall portion only at spaced apart locations.

2. The fitment of claim 1 wherein, as viewed from either of the inner and outer ends, the body has a substantially boat-shaped periphery defining two opposite edges and two opposite, side wall portions, each having said steps defining said shoulders.

3. The fitment of claim 2 wherein the fitment has a fin projecting from each of the opposite edges.

4. The fitment of claim 1 wherein each said sealing surface is adapted for sealing to one of the web portions of the collapsible pouch when the fitment is received by the opening of the collapsible pouch, the sealing surfaces tapering from one said end of the fitment toward the other end of the fitment.

5. The fitment of claim 4 wherein the sealing surfaces taper inwardly from the inner end toward the outer end, the peripheral dimension being largest at or toward the inner end and being smallest at or toward the outer end.

6. The fitment of claim 5 wherein, as viewed from either of the inner and outer ends, the body has a substantially boat-shaped periphery defining two opposite edges and two side wall portions, each having said steps defining said shoulders.

7. The fitment of claim 6 wherein the fitment has a fin projecting from each of the opposite edges.

8. The fitment of claim 4 wherein the sealing surfaces taper inwardly from the outer end toward the inner end, the peripheral dimension being largest at or toward the outer end and being smallest at or toward the inner end.

9. The fitment of claim 8 wherein, as viewed in any plane that is located between the outer and inner ends and that coincides with or is parallel to the reference plane, the body has a substantially boat-shaped periphery defining two opposite edges and two side wall portions, each having said steps defining said shoulders.

10. The fitment of claim 9 wherein the fitment has a fin projecting from each of the opposite edges.

* * * * *